US006513626B2

(12) United States Patent
MacSweeney et al.

(10) Patent No.: US 6,513,626 B2
(45) Date of Patent: Feb. 4, 2003

(54) RELEASABLY SECURE LADDER PLATFORM

(76) Inventors: Terry MacSweeney, Unit 103, 235 Carlaw Avenue, Toronto, Ontario (CA), M4M 2S1; Edward J. Burke, 37 Standish Avenue, Toronto, Ontario (CA), M4W 3B2

( * ) Notice: Subject to any disclaimer, the term of this patent is extended or adjusted under 35 U.S.C. 154(b) by 0 days.

(21) Appl. No.: 09/827,344

(22) Filed: Apr. 6, 2001

(65) Prior Publication Data

US 2001/0052437 A1 Dec. 20, 2001

Related U.S. Application Data

(60) Provisional application No. 60/204,788, filed on May 17, 2000.

(30) Foreign Application Priority Data

Apr. 7, 2000 (CA) ..... 2304914

(51) Int. Cl.[7] ..... E04G 1/00; B25G 3/20

(52) U.S. Cl. ..... 182/129; 248/210; 206/372; 403/374.1

(58) Field of Search ..... 182/129, 121; 206/372, 373; 248/210, 238, 211; 403/374.5, 374.1, 322.4

(56) References Cited

U.S. PATENT DOCUMENTS

| | | | | | |
|---|---|---|---|---|---|
| 3,987,993 | A | * | 10/1976 | Hopkins | 248/210 |
| 4,025,016 | A | * | 5/1977 | Brothers | 248/210 |
| 4,979,710 | A | * | 12/1990 | Baldwin | 248/210 |
| 5,106,045 | A | * | 4/1992 | Bezotte | 182/129 X |
| 5,556,221 | A | * | 9/1996 | Brunner | 403/322.4 |
| 5,967,259 | A | * | 10/1999 | Williams | 182/129 |
| 5,971,102 | A | * | 10/1999 | Brown | 182/129 |
| 6,000,497 | A | * | 12/1999 | Kain et al. | 182/129 |
| 6,024,192 | A | * | 2/2000 | Griffin | 182/129 |
| 6,029,776 | A | * | 2/2000 | Brown | 182/129 |
| 6,148,958 | A | * | 11/2000 | Ahl et al. | 182/129 |

* cited by examiner

*Primary Examiner*—Daniel P. Stodola
*Assistant Examiner*—Hugh B. Thompson
(74) *Attorney, Agent, or Firm*—John R. S. Orange; Orange & Chari

(57) ABSTRACT

A transport assembly for transporting an object axially along a rail of a ladder. The assembly comprises a platform for supporting the object at a selected axial position. A coupling mechanism is employed to slidably connect the platform to the rail. The coupling mechanism includes a locking mechanism and a connector for connecting the coupling mechanism to the platform. Axial displacement of the object along the rail is such that the locking mechanism permits relative axial displacement of the assembly with respect to the rail in a first direction, and inhibits the relative axial displacement in a second direction opposite to the first direction.

35 Claims, 9 Drawing Sheets

RELEASABLY SECURE LADDER PLATFORM

This application claims benefit of Provisional No. 60/204,788 filed May 17, 2000.

The present invention relates to a carrier for use with a ladder.

BACKGROUND OF THE INVENTION

There have always been inherent problems with the transportation and use of tools up and down a ladder. One known solution is to attach a container by means of a rope to a pulley, which is usually secured to a bracket at the top of the ladder. A person can place tools in the container and then raise or lower the tools by pulling on the rope. The disadvantage with this system is that the container is not sufficiently stable for the transportation of liquids in open top containers, such as paint cans. A further problem is that operation of this system is awkward while the person is on the ladder. Grasping the rope requires the person to let go of the ladder, thereby posing a potential safety hazard.

Other solutions include an S hook for hanging a paint can on a ladder portion, or plastic trays that are hooked onto a rung. These systems can require the person to push away from the ladder to access a tool or other materials supported by these devices, thereby creating a potential safety concern.

Another product is a saddle carrier having two bags connected by a middle portion, which can be hung around a rung of a ladder. The person first places the tools in the saddle carrier and then holds on to the carrier while climbing the ladder. The person then hangs the carrier around a selected rung upon reaching a desired height, thereby providing support for the tools at a selected vertical location. This method poses a potential safety hazard, as carrying of the carrier may interfere with the person's movements, while climbing or descending the ladder.

Also available are "A" type ladders that have a platform attached at a fixed location. The platform provides a user on the ladder with a stable support for tools and paint containers when not in use. However, the person must climb the ladder while holding the tools in order to place them on the platform. This system also poses a potential safety hazard, as the carried tools may interfere with the person's movement while climbing the ladder. Another problem with this system is that the fixed platform may not always be located in a convenient location, while using the ladder.

It is an object of the present invention to obviate or mitigate the above presented disadvantages.

SUMMARY OF THE INVENTION

According to the present invention there is provided a tool carrier for use with a ladder. The assembly comprises a platform and a coupling mechanism to connect the platform to a rail of the ladder. The coupling mechanism includes a locking member engageable with the ladder to secure the carrier in a selected axial position along the rail. Axial displacement of the platform along the rail is such that the locking mechanism permits relative axial displacement of the assembly with respect to the rail in a first direction, and inhibits the relative axial displacement in a second direction opposite to the first direction.

A further aspect of the invention provides a coupling apparatus for use with a ladder. The coupling apparatus comprises a body having a pair side portions connected to a back portion. The pair of side portions are placed in a spaced apart relationship to define an interior for receiving the rail. The coupling has a connector for securing the object to the body, and a locking mechanism to monitor relative axial displacement of the body with respect to the rail. The displacement is permitted by the locking mechanism in a first direction and inhibited in a second direction opposite to, the first direction.

BRIEF DESCRIPTION OF THE DRAWINGS

Embodiments of the present invention will now be described by way of example only with reference to the accompanying drawings, in which.

DESCRIPTION OF THE PREFERRED EMBODIMENTS

Figure 1:
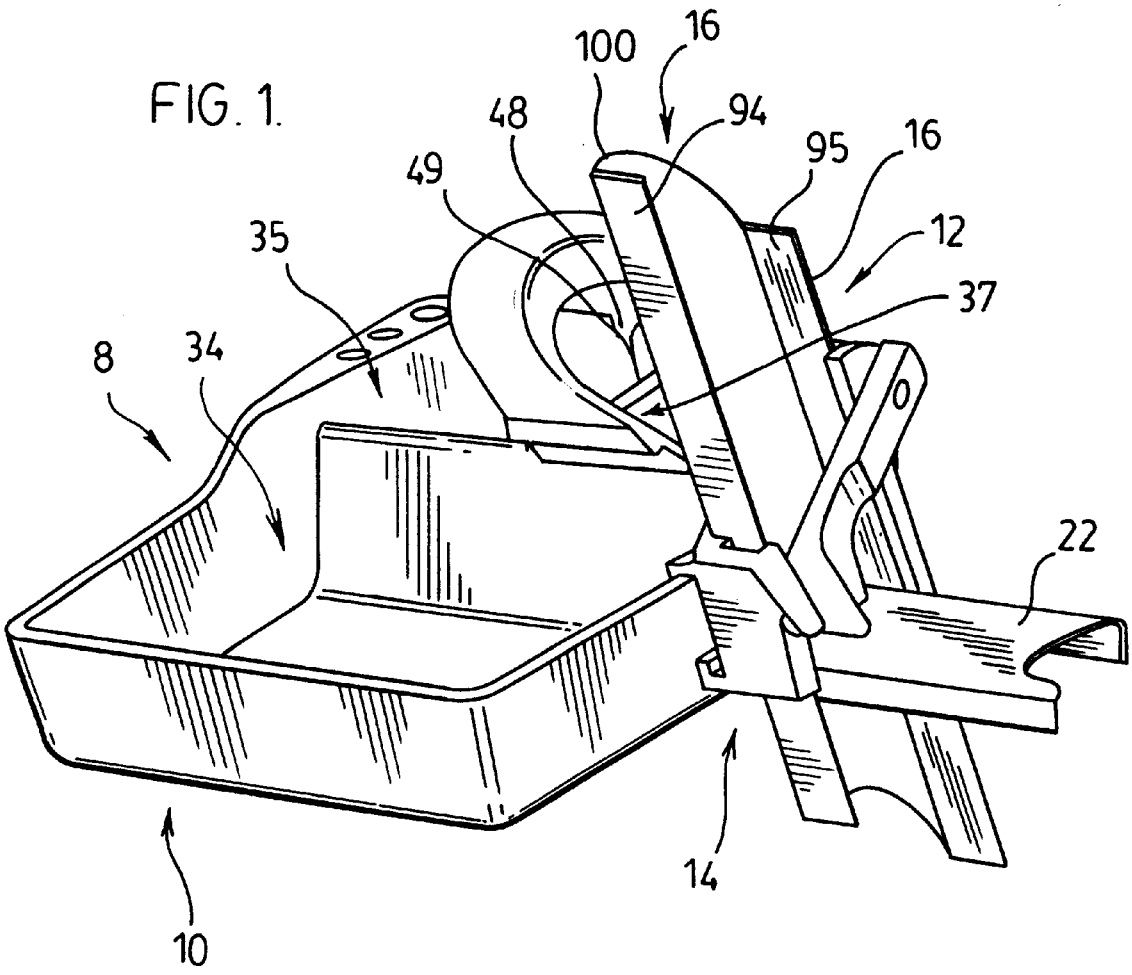
FIG. 1 is a rear perspective view of a tool carrier coupled to a ladder.

Referring to FIG. 1, a tool carrier 8 comprises a tray 10 attached to a ladder 12 by a coupling 14. The coupling 14 permits selective attachment of the tray 10 to a rail 16 of the ladder 12, whereby the tray 10 is cantilevered to one side, preferably the right side. This arrangement provides a platform secured at a selected longitudinal location, which can be used by a person (not shown) on the ladder 12. The tool carrier 8 can be employed to carry a variety of trade and household objects (not shown), such as but not limited to tools, paint, and paint brushes.

The tray 10 is configured to facilitate the performance of common trade and household repairs at elevated locations, and has a pair of side walls 24, 26, a front wall 28, and a rear wall 30 The walls 24, 26, 28, 30 extend from and are connected to a bottom wall 32 to form an open topped interior 34. Internal dividing walls 36, 38 can be used to separate the interior 34 into separate compartments 35,37, 39 for holding the objects. The tray 10 includes a series of holes 46 provided on a flange 27, projecting from the wall 26, to retain tools such as screwdrivers and pliers. A crevice 48 is located on the rear wall 30 to hold pieces of cloth, such as rags, and a circular depression 50 is located on the bottom 32 to facilitate placement of cylindrical containers in the interior 34 of the tray 10, such as paint cans. The crevice can include an arcuate portion 49 in order to retain an extension cord (not shown), if desired.

Figure 3:
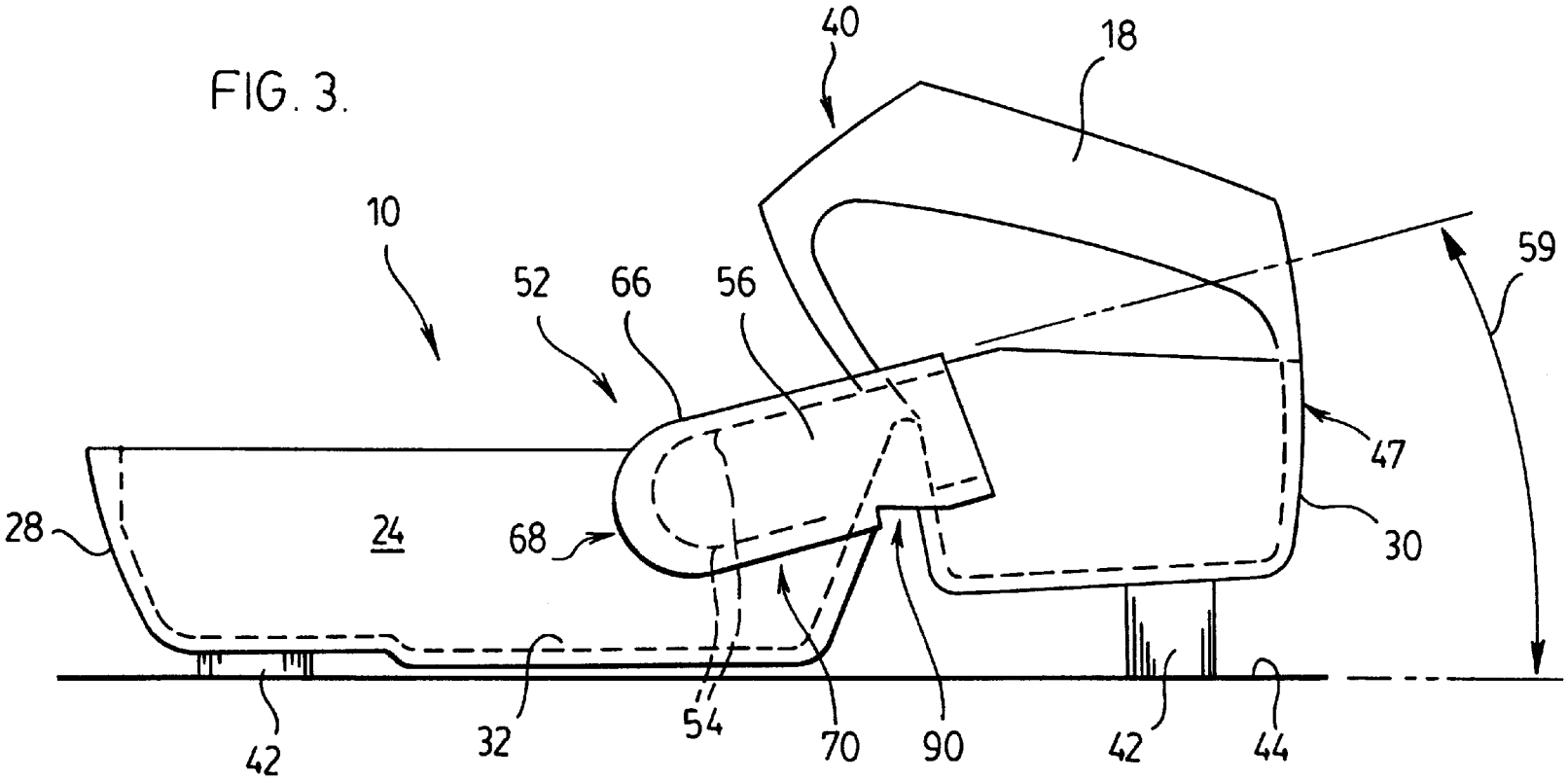
FIG. 3 is a section 3—3 side view of FIG. 2.

Referring to FIG. 3, a handle 18 includes an extended portion 40 to allow the user to carry the tray 10 approximately above its center of gravity and is connected to the rear wall 30 and the divider 38 at either end, such as by adhesive, threaded fasteners, or a clip. A set of feet 42 are connected to the bottom 32 to provide stability for the tray 10, when placed on a flat surface 44.

Figure 2:
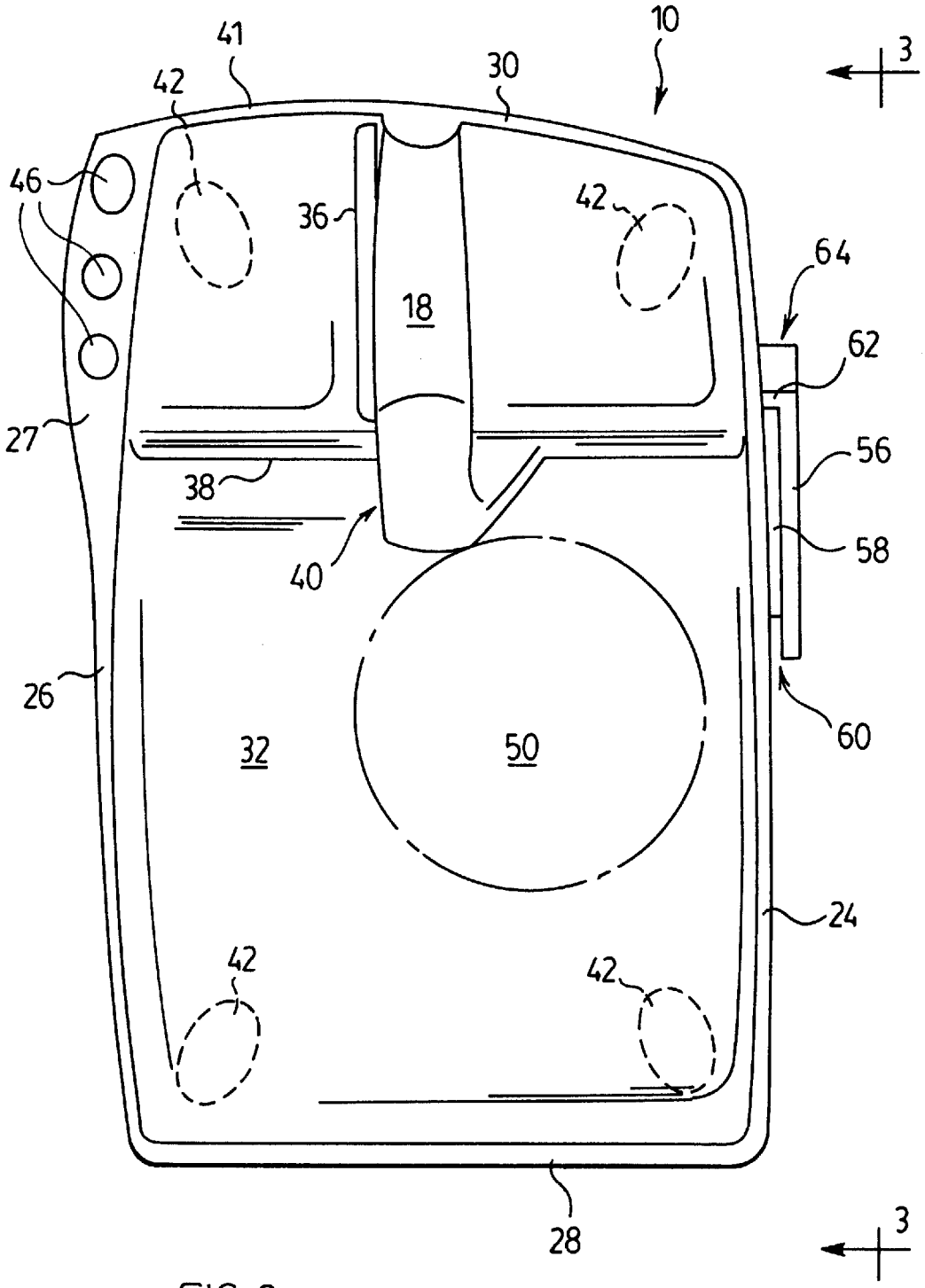
FIG. 2 is a plan view of a tray of the tool carrier of FIG. 1.
Figure 8:
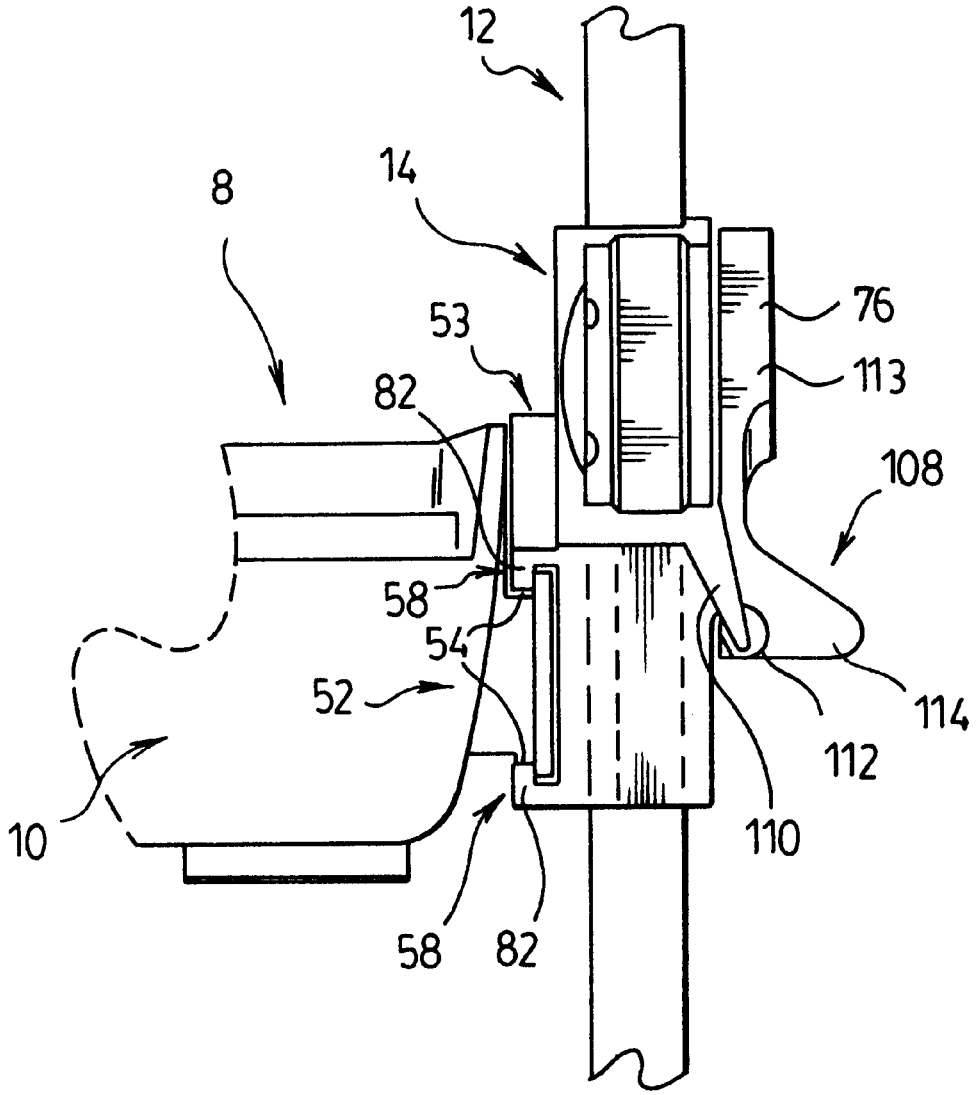
FIG. 8 is an end view of FIG. 1.

The tray 10 is detachably secured to the coupling 14 by a connector 52, positioned on the side wall 24, mateable with a corresponding connector 53 on the coupling 14. The connector 52 has a pair of approximately parallel guide surfaces 54 extending from and along the side wall 24. A plate 56 having a top edge 66, a front edge 68, and a bottom edge 70, is connected adjacent to the guide surfaces 54 to form a pair of U-shaped tracks 58. Referring to FIGS. 2 and 8, the tracks 58 are in a spaced apart relationship on a top and bottom of the connector 52, are open at one end 60, and are closed by an abutment surface 62 at the other end 64.

Figure 4:
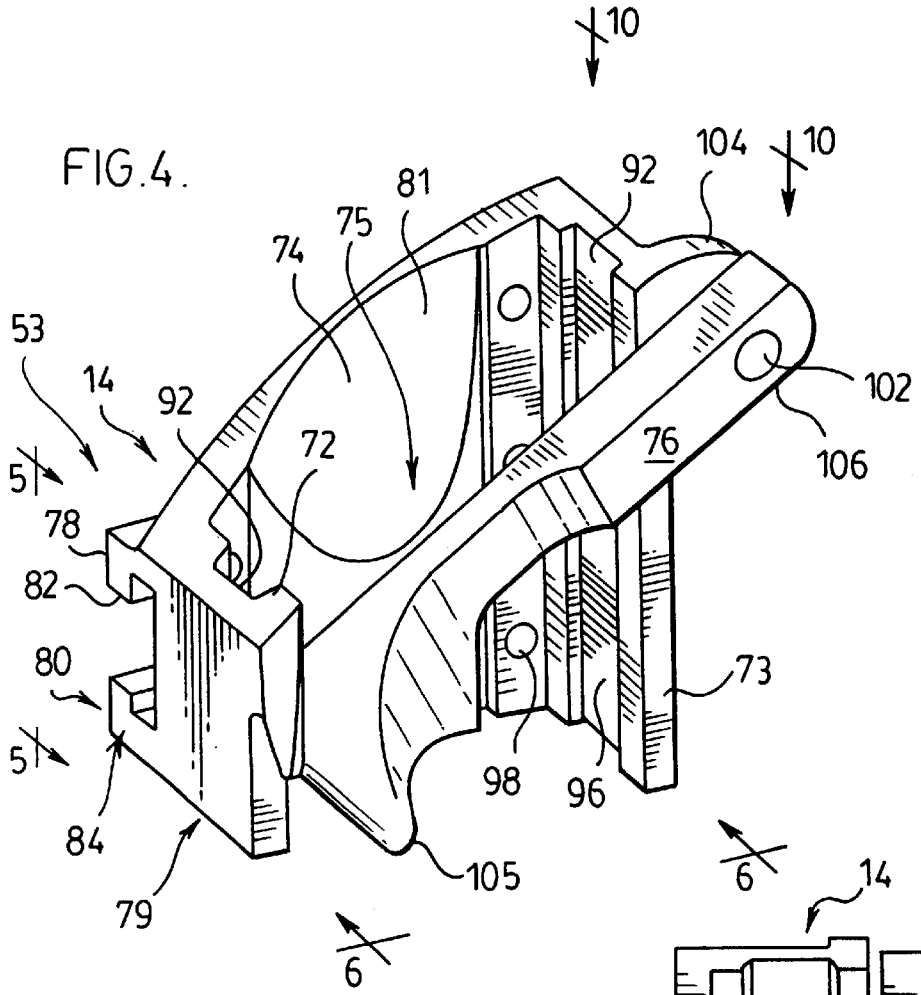
FIG. 4 is a perspective view of a coupling of FIG. 1.

Referring to FIG. 4, the coupling 14 includes the complementary connector 53 formed on a backplate 74, which extends between a pair of side walls 72, 73. The connector 53 comprises a pair of L-shaped members 78, 80 secured to the back plate 74, in a spaced apart relationship corresponding to that of the tracks 58 on the tray 10. Runner portions 82 on the members 78, 80 are slidably received in the tracks 58 and rest against the guide surface 54, when the connector 53 is coupled to the connector 52, as shown in FIG. 8. The runner portions 82 are fully received in the tracks 58, when an end face 84 of the members 78, 80 contacts the abutment surface 62.

Separation of the connectors 52, 53 is inhibited by a detent, formed by the engagement of a barb 86 located on the upper surface 88 (see FIG. 6) with a corresponding recess 90 located on the edge 70 of the plate 56 (see FIG. 3). An interference fit between the tracks 58 and the runners 182 can also be used to inhibit separation of the connector 53 from the connector 52, once the coupling 14 is connected to the tray 10. The guide surfaces 54 are inclined by approximately 11° to 20°, preferably 17°, with respect to the bottom wall 32. This angle of inclination 59 also helps to retain the connection of the tray 10 and the coupling 14, by the connectors 52, 53, due to cooperation of the weight of the tray 10 and contact between the end face 84 and the abutment surface 62. When the carrier 8 is connected to the ladder 12, an angle 59 that is too shallow may facilitate the coupling 14 becoming disconnected from the tray 10 in a transverse direction to the ladder axis. If the angle 59 is too steep, the coupling 14 may become disconnected in an axial direction during use of the carrier 8.

Referring to FIG. 4, the side walls 72, 73 of the coupling 14 are in a spaced apart relationship corresponding to a width of the rail 16. The coupling 14 has a control arm 76 extending between the side walls 72, 73, to form an interior 75 which receives the rail 16 when the coupling 14 is attached to the ladder 12, as shown in FIG. 1. Dimensions of the interior 75 should be somewhat larger than the exterior dimensions of side portions 94, 95 and face portion 100 of the rail 16, in order to facilitate connection of the coupling 14 and the rail 16. The arm 76 is preferably angled by between 30° and 60°, preferably 45°, with respect to a base surface 79 of the coupling 14.

The coupling 14 can have a series of nodules 98 positioned on the back plate 74, to provide clearance between a face portion 100 of the side rail 16 and the back plate 74. This arrangement helps to reduce friction between the side rail 16 and the back plate 74. The back plate 74 also has scallops 81, which can be used to accommodate protrusions on the face 100 such as rivet or bolt heads. The side walls 72, 73 of the coupling 14 have U-shaped channels 9 formed therein, which also provide clearance of a face 96 to accommodate any protrusions on the side portions 94, 95.

Figure 5:
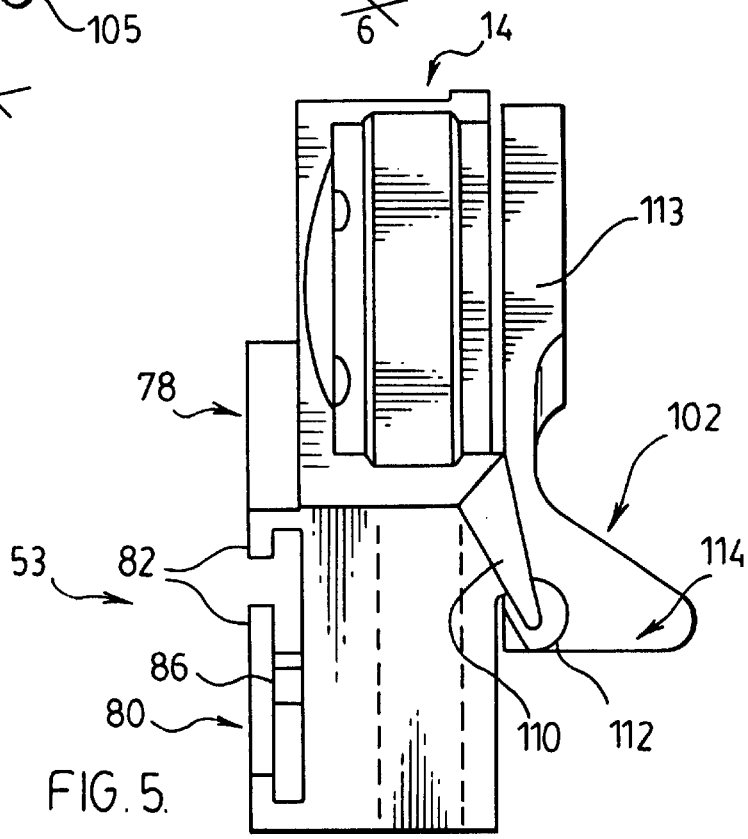
FIG. 5 is a section 5—5 end view of FIG. 4.
Figure 10:
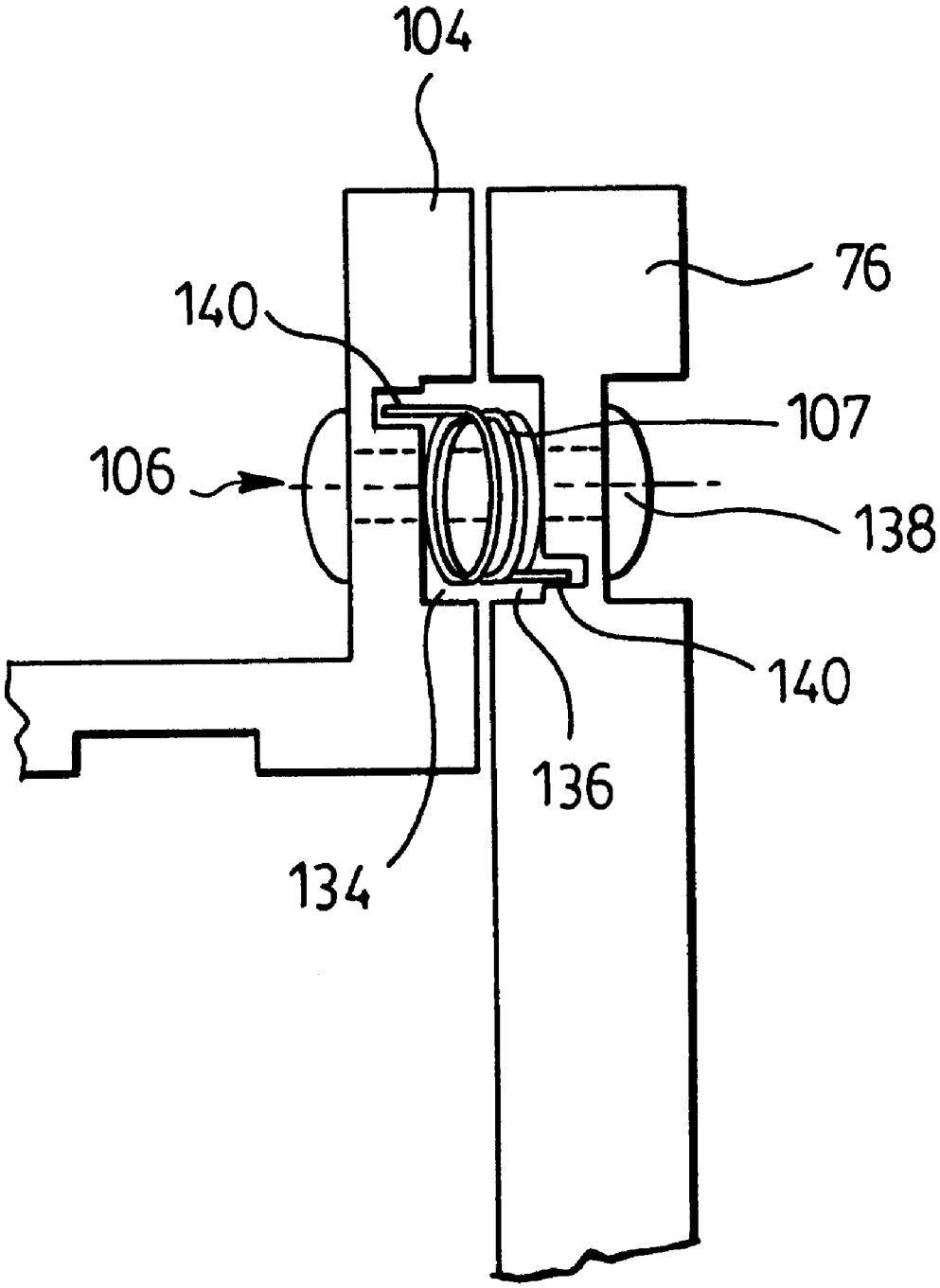
FIG. 10 is a section 10—10 top view of FIG. 4.

The axial position of the coupling 14 on the rail 16 is controlled by the arm 76. Referring to FIGS. 4, 5 and 10, the arm 76 is pivotally connected at one end portion 102 to an arcuate portion 104, by a pin joint 106. An increased thickness of the arm 76 near the pin joint can be used to inhibit breakage of the arm 76. The pin joint 106 includes a torsion spring 107 located in a cavity formed by opposing bores 134, 136. The spring can be a counterclockwise torsion spring, if desired. A threaded bolt 138 is employed to hold the components 104 and 76 together, once assembled. The spring 107 is wound around the bolt 138 and the spring ends 140 are received by corresponding bores in the components 76, 104. This arrangement biases an end portion 108 of the arm 76 towards a latch arm 110, which is connected to the side wall 72.

The latch arm 110 is received in a notch 112 formed on an end face 114 of the end portion 108. Travel of the arm 76 towards the latch arm 110 is inhibited by contact of the notch 112 against the latch arm 110, which places the arm 76 in a closed position. A surface 116 of the arm 76 is used to abut the rung 22, shown in ghosted view in FIG. 6. In this position, further movement of the tool carrier 8 down the ladder 12 is inhibited.

In operation of the tool carrier 8, the coupling 14 is releasably secured to the tray 10 by inserting the runner portions 82 in the tracks 58, as shown in FIG. 8. The coupling 14 is connected to the rail 16 by first contacting a knob 113 on the end 108 against the side portion 95, and then displacing the side wall 72 of the coupling 14 towards the side portion 94 of the ladder 12. This displacement rotates the arm 76 away from the latch arm 110, thereby providing access to the interior 75 by the rail 16. Once the side walls 72, 73 are adjacent to the corresponding side portions 94,95, the back plate 74 can be mated to the face 100 of the rail 16, thereby receiving the rail 16 by the interior 75 of the coupling 14. This arrangement places the knob 113 out of contact with the side portion 95, thereby causing the arm 76 to rotate into return contact with the latch arm 110 to enclose the rail 16 in the interior 75.

A user can climb the ladder 12 by holding the handle 18 of the tray 10 in one hand, grasping a rail 20 of the ladder 12 with the other hand, and climbing each successive rung 22 with alternating feet. This climbing arrangement can provide a three point contact between the user and the ladder 12 during use of the tool carrier 8.

Figure 6:
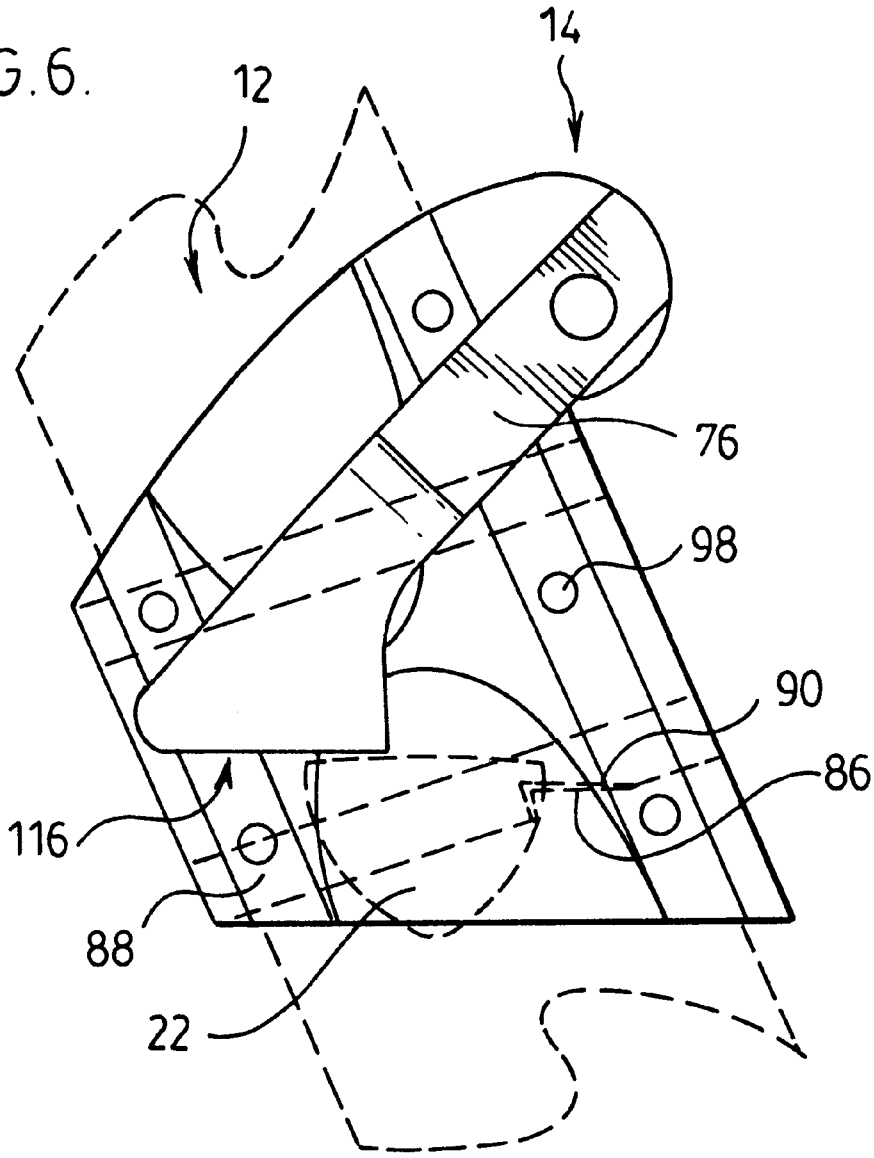
FIG. 6 is a section 6—6 side view of the coupling of FIG. 4 in a closed position.
Figure 7:
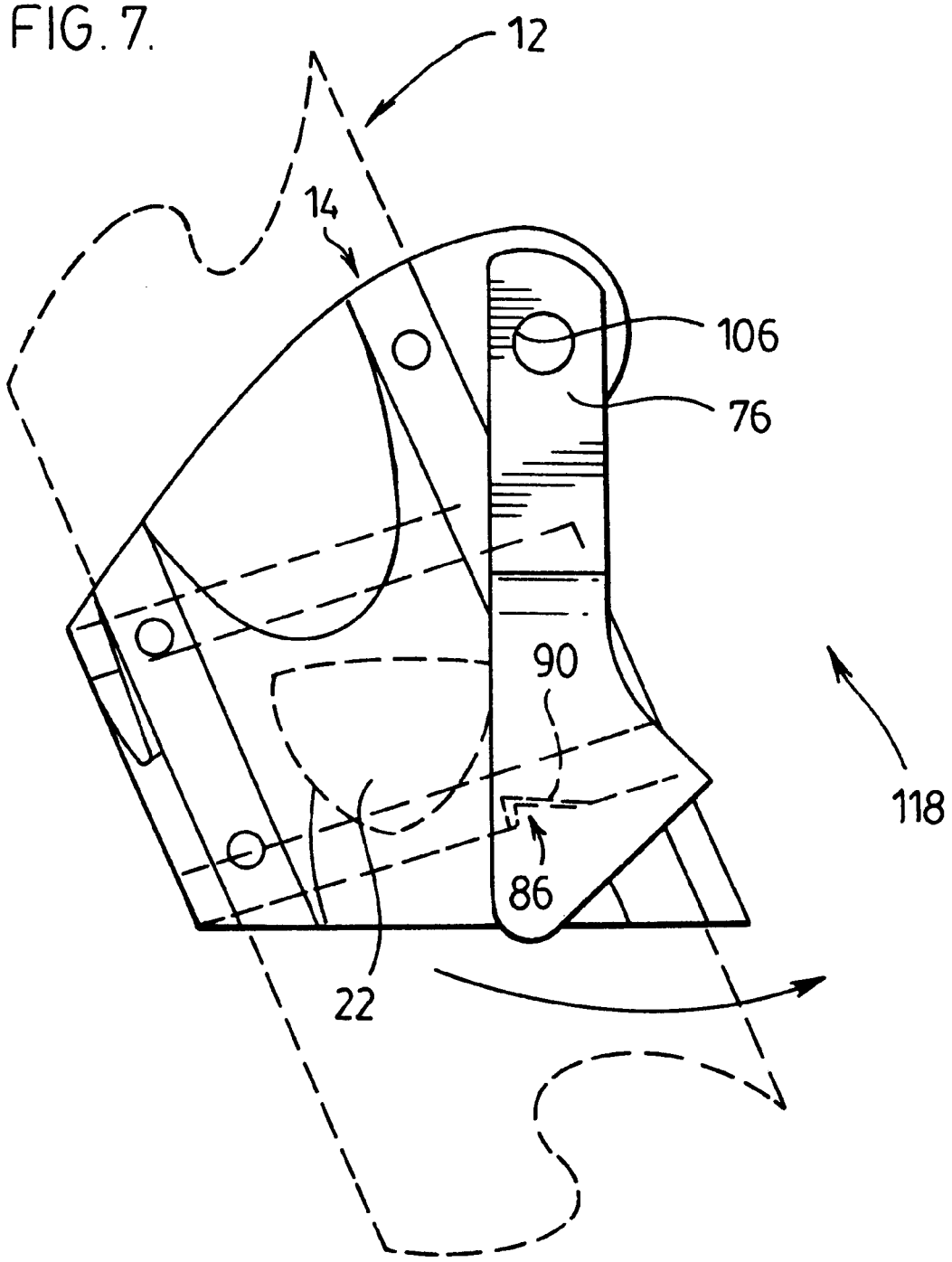
FIG. 7 shows a side view of the coupling of FIG. 6 in an open position.

Axial movement of the tool carrier 8 along the rail 16 is periodically interrupted by the series of rungs 22. Referring to FIG. 7, as the coupling 14 is displaced along the ladder 12 (shown in ghosted view) in a direction indicated by arrow 118, the arm 76 encounters the rung 22 and pivots away from the latch arm 110. Once the arm 76 has moved past the rung 22, the spring 107 will bias the end 108 into return contact with the latch arm 110. Once the latch arm 110 is received by the notch 112, the arm 76 is in the closed position. Referring to FIG. 6, the rung 22 is now positioned under the arm 76. In this position, the rung 22 is used to inhibit displacement of the coupling 14 and attached tray 10 back down the ladder 12 due to the influence of gravity. The user can now let go of the handle 18 and interact with the tool carrier 8, as its selected axial position is maintained by the arm 76. The location of the tool carrier 8 can be adjusted axially along the ladder 12 by repeating the above described operation.

The cantilevered arrangement of the tool carrier 8 with respect to the rail 16 facilitates movement of the user up and down the ladder 12, since the tray 10 and retained tools are positioned adjacent to the rungs 22 and rails 16, 20. This arrangement does not push the user backwards away from the ladder 12 while climbing thereon, as can be the case when carrying tools close to the user's body.

Detachment of the coupling 14 and the attached tray 10 from the rail 16 can be accomplished by rotating the arm 76 of the coupling 14, until the arm 76 is sufficiently positioned to the side of the interior 75. This can be accomplished either manually with the user's hand, or automatically by contacting the arm 76 with the rung 22. Once the arm 76 is rotated away from the latch arm 110, the coupling 14 can be laterally displaced away from the rail 16, thereby removing the back plate 74 from in contact with the face 100 of the rail 16. This results in the rail 16 and coupling 14 being disengaged from one another, whereby the user can carry the tool carrier 8 down the ladder 12. It should be noted that the tray 10 could be disengaged from the coupling 14 instead, to allow the user to transport the tray 10 separately down the ladder 12.

The tray 10 and coupling 14 are preferably made of a rigid material, such but not limited to as metal, fiberglass, or plastic. The connectors 52, 53 could be replaced by a permanent connection between the coupling 14 and the tray 10, such as but not limited to adhesive, mechanical fasteners such as screws or bolts, or the components 14, 10 could be integrally molded to one another.

Figure 9:
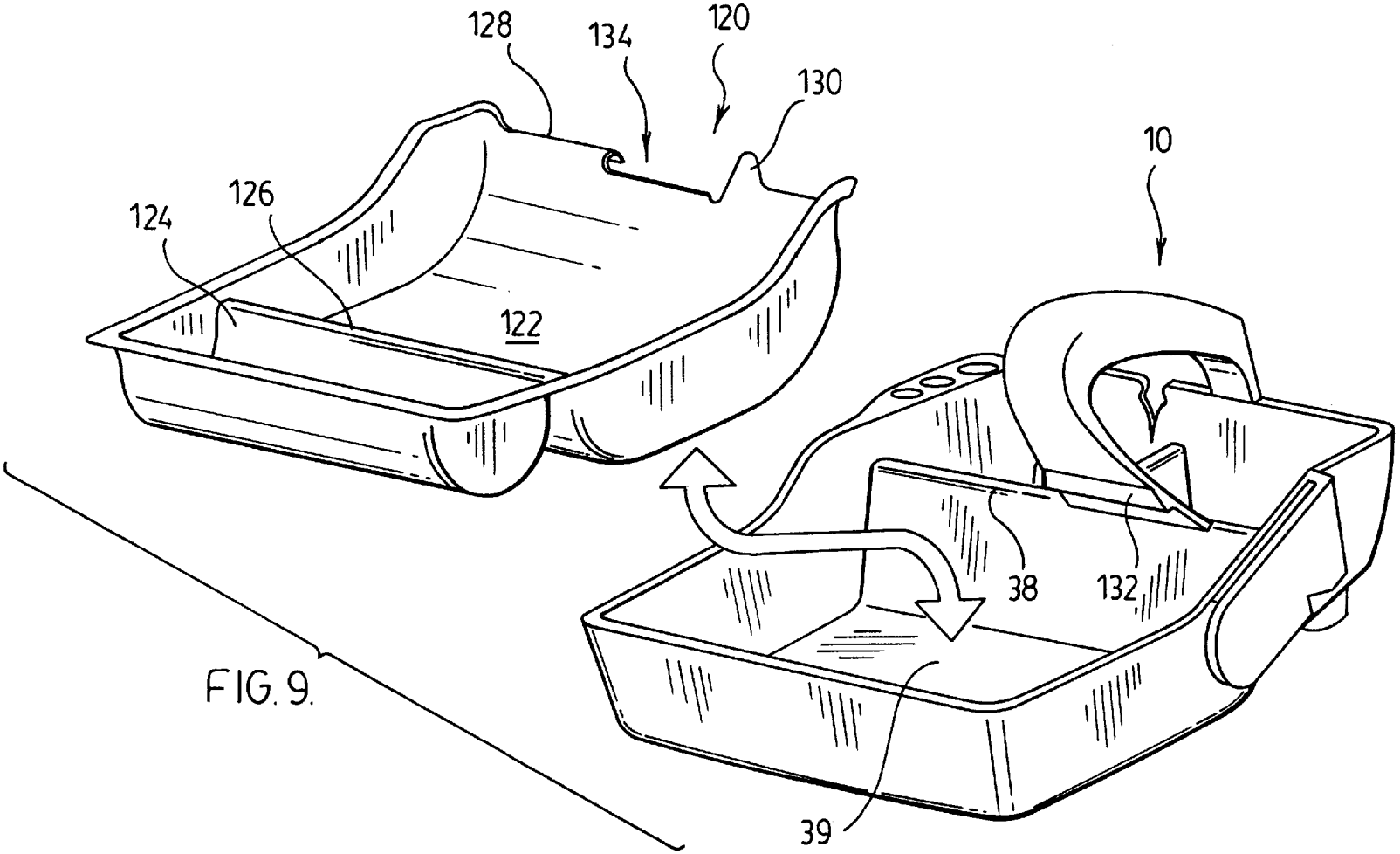
FIG. 9 is a further embodiment of FIG. 1.

An application of the tool carrier 8 includes a roller paint tray 120 supported by the tray 10, as shown in FIG. 9. The paint tray 120 has two compartments 122, 124 joined by a resilient joint 126. The compartment 122 is used to hold poured paint and the compartment 124 is used to hold a paint roller or brush (not shown), with the roller handle (not shown) accommodated in a furrow 130 adjacent to the handle 18. The paint tray 120 is supported by the tray 10 when the compartment 122 is placed in the compartment 39. A pair of tabs 128 can be employed to hook onto the dividing wall 38 for further stability of the paint tray 120 when positioned in the tray 10. A wedge 132 on the handle 18 can be employed to mate with a corresponding edge 134 located on the tray 120 for further support, if desired. The paint tray 120 is preferably made of plastic and may be a disposable product, if desired. The joint 126 should be sufficient rigid so as to support the weight of the paint roller when placed in compartment 124.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A tool carrier for use with a ladder, the carrier comprising: a platform; a coupling mechanism adapted to connect said platform to a rail of said ladder; said coupling mechanism including a locking mechanism having a body with an interior and adapted to continuously engage the rail when placed in the interior to secure said carrier in a selected longitudinal axial position along said rail; the locking mechanism having a member biased towards a locked position and connected to the body, the locking mechanism for retaining the platform in the selected axial position once placed thereto; and the biased member displaceable to provide unobstructed relative longitudinal axial displacement of the platform along said rail in a first direction, and lockable to inhibit said relative longitudinal axial displacement along said rail in a second direction opposite to said first direction to retain the platform in said selected axial position;

wherein said coupling mechanism is adapted to remain in engagement with said rail during the relative axial displacement between said platform and said rail.

2. The tool carrier of claim 1, wherein said platform and said coupling mechanism are releasably secured by a connector for connecting said coupling mechanism to said platform.

3. The tool carrier of claim 1, wherein a handle is connected to said platform for facilitating carrying by a user.

4. The tool carrier of claim 3, wherein a portion of said handle is located at a center of gravity of said platform.

5. The tool carrier of claim 1, wherein said platform has a side wall connected to and extending outwardly from a base wall.

6. The tool carrier according to claim 5, wherein said side wall extends around the periphery of said base wall to define an interior.

7. The tool carrier of claim 6, wherein a partition is employed for separating said interior into a plurality of compartments.

8. The tool carrier according to claim 5, wherein said base wall having an inward depression for locating a cylindrical container once positioned therein.

9. The tool carrier according to claim 5, wherein said side wall includes an aperture for supporting a cylindrical shaped objected.

10. The tool carrier according to claim 5, wherein said side wall includes a crevice for holding an object made of fabric.

11. The tool carrier of claim 1, wherein said coupling mechanism includes a complementary interengaging formation of a male portion and a female portion for releasably securing said coupling mechanism to said platform.

12. The tool carrier of claimed 11, wherein said female portion comprises a channel and said male portion comprising a corresponding tongue.

13. The tool carrier according to claim 12, wherein a pair of said female portions and male portions are employed in a substantially parallel spaced apart relationship.

14. The tool carrier of claim 12, wherein said portions are inclined approximately 17° with respect to a horizontal plane.

15. The tool carrier according to claim 11, wherein the connection includes an interference fit between said portions.

16. The tool carrier according to claim 15, wherein said portions further include a lock comprising a coupling having a recess and a corresponding protrusion for inhibiting separation of said portions once engaged.

17. The tool carrier according to claim 1, wherein said body has a pair of side portions connected to a back portion, said pair of side portions placed in a spaced apart relationship to define an interior adapted to receive said rail.

18. The tool carrier according to claim 17, wherein said portions have at least one channel integral to said body.

19. The tool carrier according to claim 18, wherein said channel adapted to inhibit lateral relative displacement between said body and ladder protrusions on said rail when coupled thereto.

20. The tool carrier according to claim 17, wherein said back portion has at least one protrusion adapted to inhibit substantial contact between a surface of said back portion and an outwardly facing surface of said rail, the protrusion adapted to facilitate the displacement of said platform relative to said rail.

21. The tool carrier of claim 20, wherein said coupling mechanism includes a support portion for releasably securing said coupling mechanism to said platform.

22. The tool carrier according to claim 17, wherein said member further comprises an arm spaced from said back portion and extending between the side portions adapted to encompass said rail and adapted to inhibit lateral movement of said coupling mechanism with respect to said ladder.

23. The tool carrier according to claim 22, wherein said arm has a first portion pivotally connected to a pivot axis on said body.

24. The tool carrier according to claim 23, wherein said first portion further has a resilient member to provide the bias of said arm in the locked direction.

25. The tool carrier according to claim 24, wherein said arm comprises a second portion having a latch mechanism for inhibiting rotation of said arm about said pivot axis in a first rotational direction.

26. The tool carrier according to claim 25, wherein said arm further includes an arcuate portion adapted to position adjacent to a rung of the ladder.

27. The coupling apparatus according to claims 25, wherein an angle contained between said arm, and a base of said locking mechanism is approximately 45°.

28. A coupling apparatus for facilitating relative longitudinal axial displacement between an object and a rail of a ladder, the coupling apparatus comprising: a body with an interior adapted to provide continuous engagement with the rail when placed in the interior, the body having a pair of side portions connected to a back portion, said pair of side portions placed in a spaced apart relationship to define the interior; a connector on the body adapted to secure said object to said body; and a locking mechanism having a member connected to the body and biased towards a locked position for retaining the body in a selected axial position once placed thereto, the biased member displaceable to permit unobstructed relative longitudinal axial displacement of the body along said rail in a first direction, and lockable to inhibit said relative longitudinal axial displacement along said rail in a second direction opposite to said first direction to retain the body in said selected axial position; wherein said coupling apparatus is adapted to remain in engagement with said rail during the relative axial displacement between said object and said rail.

29. The coupling apparatus according to claim 28, wherein said portions have at least one channel integral to said body adapted to receive a portion of said rail.

30. The coupling apparatus according to claim 28, wherein said back portion has at least one protrusion adapted to inhibit substantial contact between a surface of said back portion and an outwardly facing surface of said rail, the protrusion adapted to facilitate the displacement of said body relative to said rail.

31. The coupling apparatus according to claim 28, wherein said member comprises an arm spaced from said back portion and extending between the side portions, adapted to encompass said rail and adapted to inhibit lateral movement between said body and said ladder.

32. The coupling apparatus according to claim 31, wherein said arm has a first portion pivotally connected to a pivot axis on said body.

33. The coupling apparatus according to claim 32, wherein said first portion further has a resilient member to provide the bias of said arm in the locked direction.

34. The coupling apparatus according to claim 32, wherein said arm comprises a second portion having a latch mechanism for inhibiting rotation of said arm about said pivot axis in a first rotational direction.

35. The coupling apparatus according to claim 34, wherein said arm further includes an arcuate portion adapted to support a rung of the ladder.

* * * * *